US008690081B2

(12) United States Patent
Cornet et al.

(10) Patent No.: US 8,690,081 B2
(45) Date of Patent: Apr. 8, 2014

(54) FLUID DISPENSER HEAD

(75) Inventors: Gérard Cornet, Blaru (FR); Alexandra Parmentier, Menilles (FR); Florent Pouliaude, Fouqueville (FR)

(73) Assignee: Aptar France SAS, Le Neubourg (FR)

( * ) Notice: Subject to any disclaimer, the term of this patent is extended or adjusted under 35 U.S.C. 154(b) by 104 days.

(21) Appl. No.: 13/159,986

(22) Filed: Jun. 14, 2011

(65) Prior Publication Data

US 2011/0303768 A1 Dec. 15, 2011

Related U.S. Application Data

(60) Provisional application No. 61/419,098, filed on Dec. 2, 2010.

(30) Foreign Application Priority Data

Jun. 14, 2010 (FR) ..... 10 54671

(51) Int. Cl.
*B05B 1/34* (2006.01)
*B05B 1/26* (2006.01)
*B65D 83/00* (2006.01)

(52) U.S. Cl.
USPC ..... 239/493; 239/491; 239/461; 239/469; 222/402.1

(58) Field of Classification Search
USPC ..... 239/461, 463, 468, 469, 474, 475, 239/486–497, 337, 470; 222/402.1, 222/402.11–402.25
See application file for complete search history.

(56) References Cited

U.S. PATENT DOCUMENTS

| | | | | | |
|---|---|---|---|---|---|
| 3,061,202 | A | * | 10/1962 | Tyler | 239/333 |
| 3,075,708 | A | * | 1/1963 | Cooprider | 239/490 |
| 3,112,074 | A | | 11/1963 | Green | |
| 3,625,437 | A | | 12/1971 | Garrigou | |
| 4,157,789 | A | * | 6/1979 | Laauwe | 239/327 |
| 4,187,985 | A | * | 2/1980 | Goth | 239/337 |
| 4,313,569 | A | * | 2/1982 | Burke | 239/333 |
| 4,358,057 | A | * | 11/1982 | Burke | 239/333 |
| 4,640,444 | A | * | 2/1987 | Bundschuh | 222/321.7 |
| 5,358,179 | A | * | 10/1994 | Lund et al. | 239/333 |
| 5,526,985 | A | * | 6/1996 | Martin | 239/478 |
| 5,622,318 | A | * | 4/1997 | Bougamont et al. | 239/490 |
| 5,722,598 | A | | 3/1998 | Werding | |
| 5,878,959 | A | * | 3/1999 | Smolen et al. | 239/121 |

(Continued)

FOREIGN PATENT DOCUMENTS

| | | |
|---|---|---|
| EP | 0663240 A1 | 7/1995 |
| FR | 2016334 A1 | 5/1970 |

(Continued)

*Primary Examiner* — Len Tran
*Assistant Examiner* — Alexander M Valvis
(74) *Attorney, Agent, or Firm* — Sughrue Mion, PLLC

(57) ABSTRACT

A fluid dispenser head including an inlet well (14), an axial assembly housing (2) in which there extends a pin (3), and a nozzle (4) assembled along an axis X in the axial assembly housing (2). The head also includes two feed ducts (15), each connecting the inlet well (14) to the axial assembly housing (2). The pin forms two swirl channels (35) connected in tangential manner to a swirl chamber (36). The nozzle is in sealing contact with the pin (3) so as to define two connection sections, each connecting a feed duct (15) to a swirl channel (35).

14 Claims, 3 Drawing Sheets

(56) References Cited

U.S. PATENT DOCUMENTS

| | | | | |
|---|---|---|---|---|
| 5,931,386 | A | 8/1999 | Jouillat | |
| 6,095,436 | A * | 8/2000 | Seegers et al. | 239/403 |
| 6,241,165 | B1 * | 6/2001 | Bickart et al. | 239/491 |
| 6,311,900 | B1 * | 11/2001 | Slowik et al. | 239/533.12 |
| 6,394,321 | B1 * | 5/2002 | Bayer | 222/402.24 |
| 6,443,370 | B1 * | 9/2002 | Brulle et al. | 239/333 |
| 7,066,408 | B2 * | 6/2006 | Sugimoto et al. | 239/461 |
| RE39,767 | E * | 8/2007 | Soule et al. | 239/468 |
| 7,300,001 | B2 * | 11/2007 | Kuo | 239/333 |
| 7,316,364 | B2 * | 1/2008 | Larsen | 239/589 |
| 7,320,440 | B2 * | 1/2008 | Prociw et al. | 239/491 |
| 7,748,572 | B2 * | 7/2010 | Althoff et al. | 222/153.11 |
| 7,748,648 | B2 * | 7/2010 | Songbe et al. | 239/468 |
| 7,857,174 | B2 * | 12/2010 | Michaux et al. | 222/507 |
| 7,891,525 | B2 * | 2/2011 | Behar et al. | 222/153.13 |
| 2003/0080204 | A1 * | 5/2003 | Martin | 239/106 |
| 2003/0098369 | A1 * | 5/2003 | Foster et al. | 239/343 |
| 2005/0103900 | A1 * | 5/2005 | Varble et al. | 239/533.12 |
| 2005/0155980 | A1 * | 7/2005 | Neuhalfen | 222/95 |
| 2007/0194146 | A1 * | 8/2007 | Dorendorf | 239/419.3 |
| 2007/0262171 | A1 * | 11/2007 | Wong | 239/296 |
| 2011/0005232 | A1 * | 1/2011 | Williams et al. | 60/748 |
| 2011/0031328 | A1 * | 2/2011 | Rundle et al. | 239/7 |
| 2012/0034071 | A1 * | 2/2012 | Tabata | 415/148 |
| 2012/0228405 | A1 * | 9/2012 | Buelow et al. | 239/463 |

FOREIGN PATENT DOCUMENTS

| | | | |
|---|---|---|---|
| FR | 2399282 | A1 | 3/1979 |
| WO | 94/27729 | A1 | 12/1994 |
| WO | 96/21512 | A1 | 7/1996 |

* cited by examiner

FLUID DISPENSER HEAD

CROSS REFERENCE TO RELATED APPLICATION

This application claims the benefit under 35 U.S.C. §119 (e) of U.S. provisional patent application Ser. No. 61/419,098, filed Dec. 2, 2010, and priority under 35 U.S.C. §119 (a)-(d) of French patent application No. FR-10.54671, filed Jun. 14, 2010.

TECHNICAL FIELD

The present invention relates to a fluid dispenser head for associating with a dispenser member, such as a pump or a valve. The dispenser head may be integrated in, or mounted on, the dispenser member. The dispenser head may include a bearing surface such that it constitutes a pusher on which the user presses so as to actuate the dispenser member. In a variant, the dispenser head need not have a bearing surface. This type of fluid dispenser head is frequently used in the fields of perfumery, cosmetics, or even pharmacy.

BACKGROUND OF THE INVENTION

A conventional dispenser head, e.g. of the pusher type, comprises:

- an inlet well for connecting to an outlet of a dispenser member, such as a pump or a valve;
- an axial assembly housing in which there extends a pin defining a side wall and a front wall; and
- a cup-shaped nozzle comprising a substantially-cylindrical wall having an end that is closed by a dispenser wall that forms a spray orifice, the nozzle being assembled along an axis X in the axial assembly housing, with its cylindrical wall engaged around the pin, and its dispenser wall in axial abutment against the front wall of the pin.

In general, the inlet well is connected to the axial assembly housing via a single feed duct. In addition, it is common to form a swirl system in the dispenser wall of the nozzle. A swirl system conventionally comprises a plurality of tangential swirl channels that open out into a swirl chamber that is centered on the spray orifice of the nozzle. The swirl system is disposed upstream from the spray orifice.

In addition, it is also common practice to make the nozzle in such a manner as to be circularly symmetrical around the axis X. Thus, it is not necessary to orientate the nozzle relative to the housing. Naturally, that implies that all of the swirl channels are not oriented in the same manner relative to the feed duct connecting the inlet well to the assembly housing. By way of example, one swirl channel may be disposed substantially extending the feed duct, while the other two or three swirl channels are not fed directly by the feed duct. That means that the swirl channels are not fed in identical, uniform, or symmetrical manner, with one swirl channel being more favored, and another swirl channel being less favored.

In the prior art, document EP-0 802 827 describes a particular dispenser head including two parallel feed ducts that open out into an axial assembly housing that receives a very particular nozzle of oblong shape. The dispenser head of that document makes it possible to satisfy certain particular requirements, in particular with regard to the size of the nozzle, that is of a size not much greater than a grain of rice. However, the size and the configuration of that particular nozzle create serious drawbacks. Firstly, it is not easy to take hold of the nozzle, as a result of its oblong shape. Then, it is essential to orientate the nozzle in such a manner as to present it correctly in front of the assembly housing, which is itself also oblong. Finally, it is not easy to insert the nozzle into its housing, mainly as a result of the nozzle being substantially flat. The nozzle comes into contact with a core 11 that forms an end wall of the axial assembly housing. The core is formed with a swirl system that comprises two tangential channels that open out into a central swirl chamber. On either side of the core there extend the two feed ducts that connect to the inlet well. In the design in that document, the oblong and flat nozzle penetrates into the axial assembly housing in such a manner as to come into leaktight contact with the core, but without penetrating into the lateral feed ducts. As a result, the nozzle is held in the assembly housing only at its outer periphery that is advantageously made in beveled manner so as to form an assembly edge for coming into engagement in the side wall of the assembly housing.

It is easy to understand that that particular dispenser head is difficult to assemble in industrialized manner, thereby considerably increasing its cost price.

However, an advantage of that particular dispenser head is that the swirl channels of the swirl system are fed in symmetrical manner by the two feed ducts that connect to the inlet well. Thus, each swirl channel is fed by its own feed duct. In addition, the feed ducts and the swirl channels are disposed in completely symmetrical manner relative to the swirl chamber, so that each feed duct and each swirl channel is fed in strictly identical manner with fluid coming from the inlet well. Such feed symmetry is indeed achieved with the dispenser head of document EP-0 802 827, but with considerable drawbacks associated with the shape of the nozzle and of the axial assembly housing.

BRIEF SUMMARY OF THE INVENTION

An object of the present invention is to define a dispenser head of design that is more conventional than the design in document EP-0 802 827, but that nevertheless incorporates its advantages, in particular with regard to feeding the swirl channels in symmetrical manner. A main purpose of the present invention is to simplify considerably the method of assembling the nozzle in its axial assembly housing. Another purpose is to improve the retention of the nozzle in its housing, without damaging the feed symmetry.

Thus, starting from a conventional dispenser head, the present invention proposes that it further comprises:

- at least two feed ducts, each connecting the inlet well to the axial assembly housing;
- the front wall of the pin forming at least two swirl channels that are connected in tangential manner to a swirl chamber that is centered on the spray orifice; and
- the cylindrical wall of the nozzle being in sealing contact with the side wall of the pin so as to define at least two connection sections, each connecting a feed duct to a swirl channel.

The dispenser head of the invention thus combines as many characteristics as possible of a conventional dispenser head and certain particular characteristics of the dispenser head of document EP-0 802 827. Specifically, the nozzle of the invention presents a conventional cup shape, and the assembly housing presents a pin that projects inside the housing. In addition, there are a plurality of feed ducts, and the swirl system is formed at the pin as in the dispenser head of document EP-0 802 827. To that, the invention adds the formation of two connection sections that are formed by the co-operation between the nozzle and the pin. In this way, the dispenser head presents a general configuration that is substantially conventional, but that further incorporates the advantages of the dispenser head of document EP-0 802 827, and in particular the advantages associated with feeding the swirl channels in symmetrical manner.

Advantageously, the cylindrical wall of the nozzle is in sealing contact with the side wall of the pin at at least two sealing zones that extend in substantially axial manner from the ducts to the channels so as to form the two connection sections. Thus, the sealing zones make it possible to separate the two connection sections from each other, so that each feeds only one swirl channel. Advantageously, the sealing zones are linear and/or axial. Preferably, there are four sealing zones defining the two connection sections, and there are two dead spaces. In a practical embodiment, the sealing zones may be formed by axial splines on the pin that are in contact with the cylindrical wall of the nozzle. In addition, each sealing zone may further include a radial sealing ridge that is formed in the housing, the cylindrical wall of the nozzle defining a free annular edge that comes into contact with the sealing ridges, so as to provide sealing at the end of the housing. The axial splines, possibly combined with the radial sealing ridges, thus make it possible to define two distinct connection sections, each making it possible to connect a feed duct to a swirl channel.

In another advantageous aspect of the invention, the inlet well extends along an axis Y that is transverse to the axis X, such that the feed ducts are connected over the height of the well, the heights of the two ducts in the well, along the axis Y, being identical. Thus, the fluid present in the inlet well flows identically along the feed ducts in homogenous and equivalent manner without giving priority to any duct. In this way, the swirl channels are fed in completely symmetrical and balanced manner. The flow paths of the fluid from the inlet of the feed ducts to the spray orifice, via the feed ducts, the connection sections, the swirl channels, and the swirl chamber, are identical in length and in configuration.

According to another characteristic of the invention, part of the swirl chamber is formed by the dispenser wall of the nozzle. Thus, the swirl chamber may be hollowed out completely in the pin only, or, on the contrary, the swirl chamber may be hollowed out in part in the pin and in part in the nozzle.

In another aspect of the invention, the housing and the cylindrical wall of the nozzle are circularly symmetrical around the axis X. Thus, it is not necessary to orientate the nozzle angularly relative to the axis X in order to insert it inside its assembly housing. Given that the orientation of the swirl channels and of the connection sections is imposed by the pin that is stationary relative to the assembly housing, and since the nozzle is circularly symmetrical, it cannot intervene and change their orientation.

The spirit of the invention resides in conserving the conventional configuration of the dispenser head, while guaranteeing that the swirl channels are fed in balanced, identical, and symmetrical manner. Thus, the swirl chamber receives an identical quantity of fluid from each swirl channel, and that considerably increases the quality of the vortex created inside the swirl chamber, and consequently the quality of the spray through the spray orifice. This feed symmetry turns out to be effective for all fluid compositions, and very particularly for fragrances, and even more particularly for fragrances that are partially or mostly water based.

BRIEF DESCRIPTION OF THE DRAWINGS

The invention is described more fully below with reference to the accompanying drawings that show an embodiment of the invention by way of non-limiting example.

In the figures.

DETAILED DESCRIPTION

Reference is made to all of FIGS. 1 to 4 in order to describe in detail the component parts, the assembly method, and the advantages of a dispenser head made in accordance with a non-limiting embodiment of the invention.

The dispenser head comprises two essential component parts, namely a head body 1 and a nozzle 4. The two parts can be made by injection-molding plastics material. The head body 1 is preferably made as a single part: however, it could be made from a plurality of parts that are assembled together. The same applies for the nozzle 4 that is preferably made as a single part.

Figure 2:
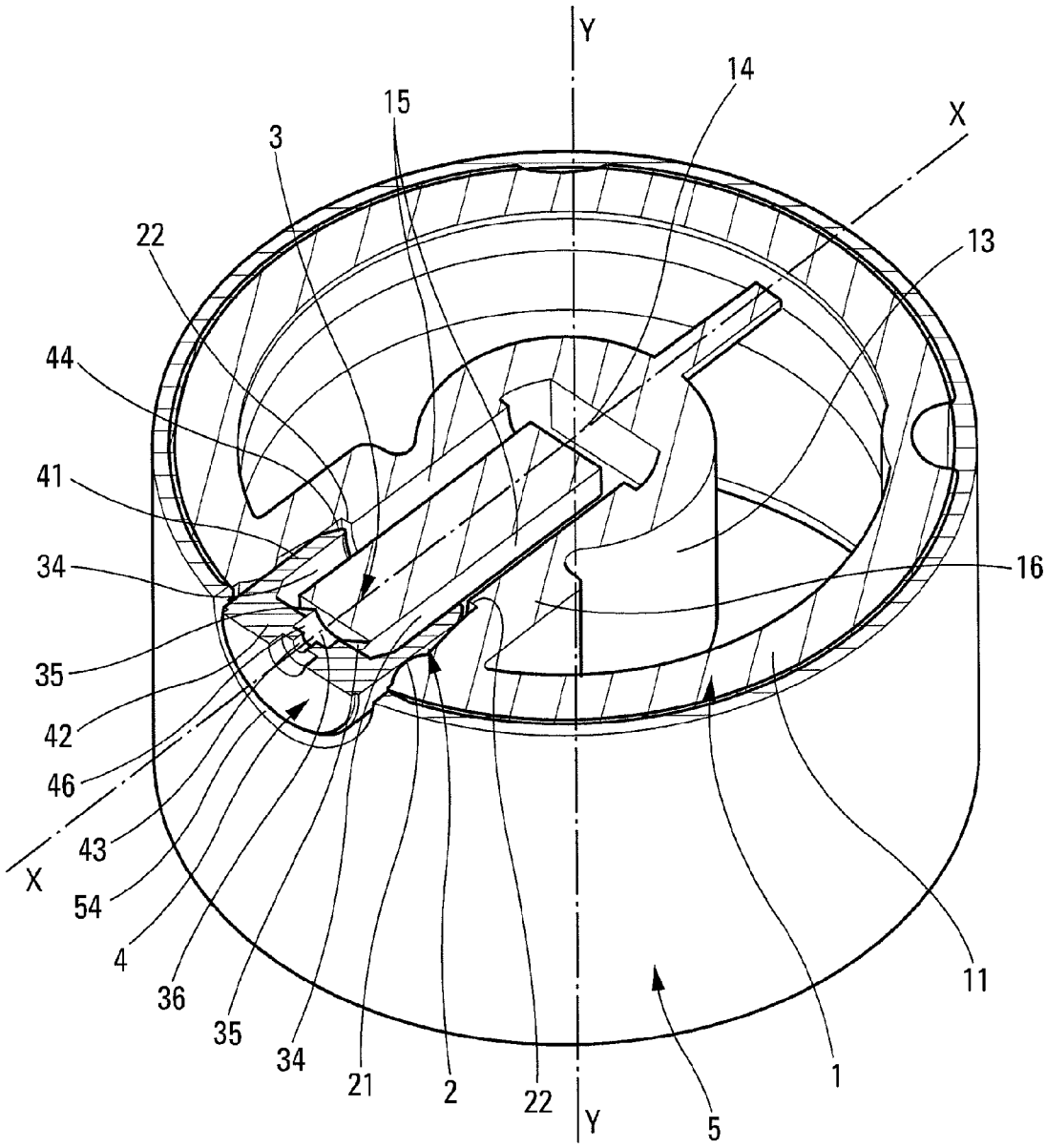
FIG. 2 is a horizontal cross-section view through the FIG. 1 dispenser device in its assembled state.

The head body 1 includes a substantially-cylindrical peripheral skirt 11 that is closed at its top end by a disk 12. The head body 1 also includes a connection sleeve 13 that, in this embodiment, extends in coaxial manner inside the peripheral skirt 11. The connection sleeve 13 extends downwards from the disk 12. The connection sleeve internally defines an inlet well 14 that is open at its bottom end, and that is closed at its top end by the disk 12. The connection sleeve 13 is for mounting on the free end of an actuator rod of a dispenser member, such as a pump or a valve. The actuator rod (not shown) is movable downwards and upwards along the axis Y. The actuator rod is hollow so as to define a flow duct that is in communication with the metering chamber of the pump or the valve. The inlet well 14 extends upwards, extending the actuator rod so that the fluid coming from the metering chamber can flow into the inlet well 14. The connection sleeve 13 is connected to the peripheral skirt 11 via a connection block 16, as can be seen in FIG. 2. The block 16 extends beneath the disk 12 along an axis X that is perpendicular to the axis Y in this embodiment. This could be otherwise. The connection block 16 internally defines two feed ducts 15 and an axial assembly housing 2. The block 16 also defines a pin 3 that projects inside the assembly housing 2. The two feed ducts 15 connect the inlet well 14 to the assembly housing 2, as can be seen very clearly in FIG. 2. It should also be observed in this figure that the two feed ducts 15 are connected to the inlet well 14 at the same height on the axis Y. The feed ducts 15 preferably have sections that are identical, and configurations that are identical. It can be said that they are disposed in symmetrical manner about the axis X. The pin 3 is also disposed on the axis X. The axial assembly housing 2 is of generally cylindrical configuration, thereby defining an inside wall 21 that is substantially cylindrical and an end wall 22 that is of complex shape. The feed ducts 15 open out into the assembly housing 2 at the end wall 22. This can be seen more clearly in FIG. 3. It should also be observed in this figure that the inside wall 21 presents fastener profiles enabling the nozzle to be held more securely, as described below.

Figure 3:
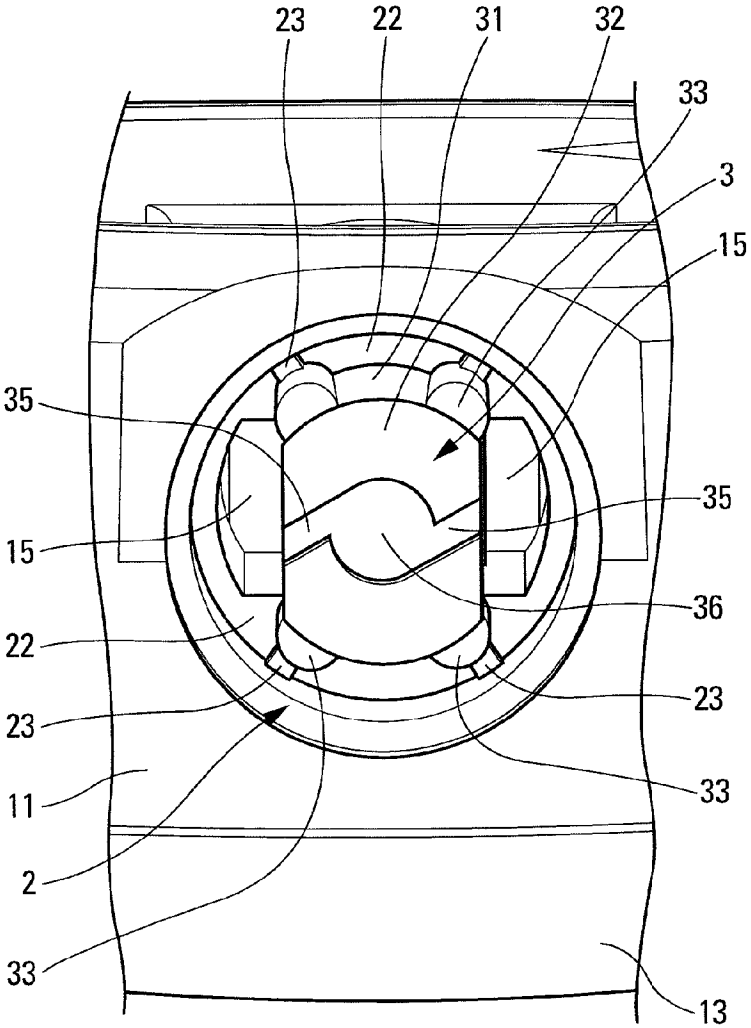
FIG. 3 is a larger-scale almost front view of the axial assembly housing of the dispenser head in FIGS. 1 and 2.

The pin 3 thus projects into the assembly housing 2 from the end wall 22. The feed ducts 15 open out into the assembly housing 2 on either side of the pin 3, as can be seen in FIG. 3. The pin 3 includes a side wall 31 that extends from the end wall 22 to a front wall 32 that defines the free end of the pin.

Figure 1:
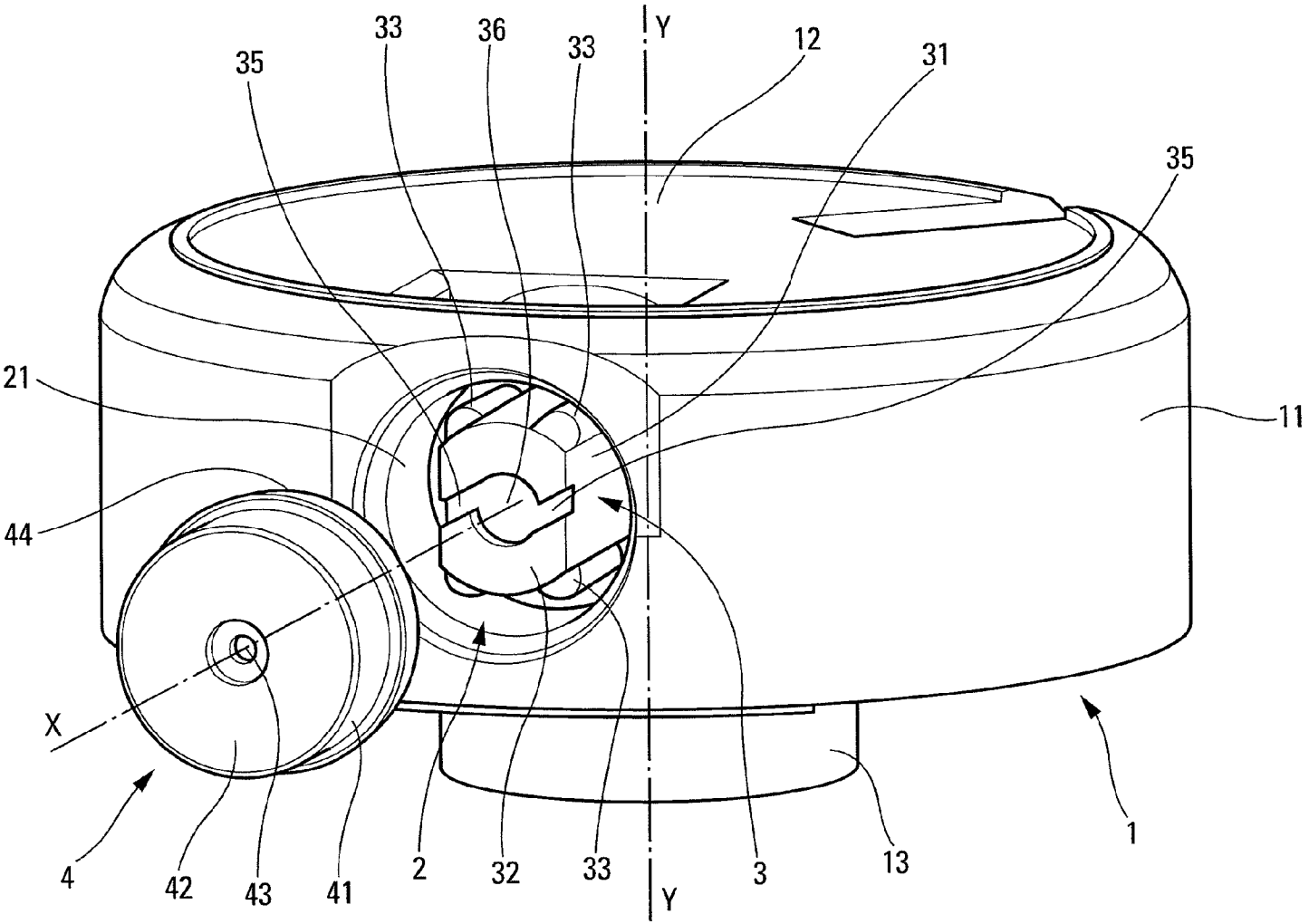
FIG. 1 is a very greatly enlarged exploded perspective view of a dispenser head in an embodiment of the invention.

The pin extends into the housing without coming into contact with its inside wall 21. In other words, the side wall 31 of the pin is not in contact with the inside wall 21 of the housing. The front wall 32 of the pin does not project out from the housing: on the contrary, it remains set back inside the housing. This can clearly be seen in FIG. 2. The front wall 32 of the pin is formed with a hollow profile that defines two tangential swirl channels 35 that are connected in tangential manner to a swirl chamber 36 that is centered on the axis X. The channels 35 open out onto the side wall 31 of the pin, as can be seen in FIG. 1. In addition, the side wall 31 of the pin is formed with four splines 33 that advantageously extend in axial manner along the axis X. The splines 33 extend from the front wall 32 to the end wall 22 of the housing 2. Where it connects with the end wall 22, each spline 33 extends in the form of a radial sealing ridge 23 that extends, advantageously diagonally, until it comes into contact with the inside wall 21 of the assembly housing 2. In general, the pin 3 presents a vertical section that is substantially rectangular, or at least elongate: the four corners of the rectangle being formed by the splines 33. The two feed ducts 15 extend along the long vertical sides of the rectangle formed by the pin. In a variant, the pin 3 could also present a section that is round or circular with four splines 33.

Figure 4:
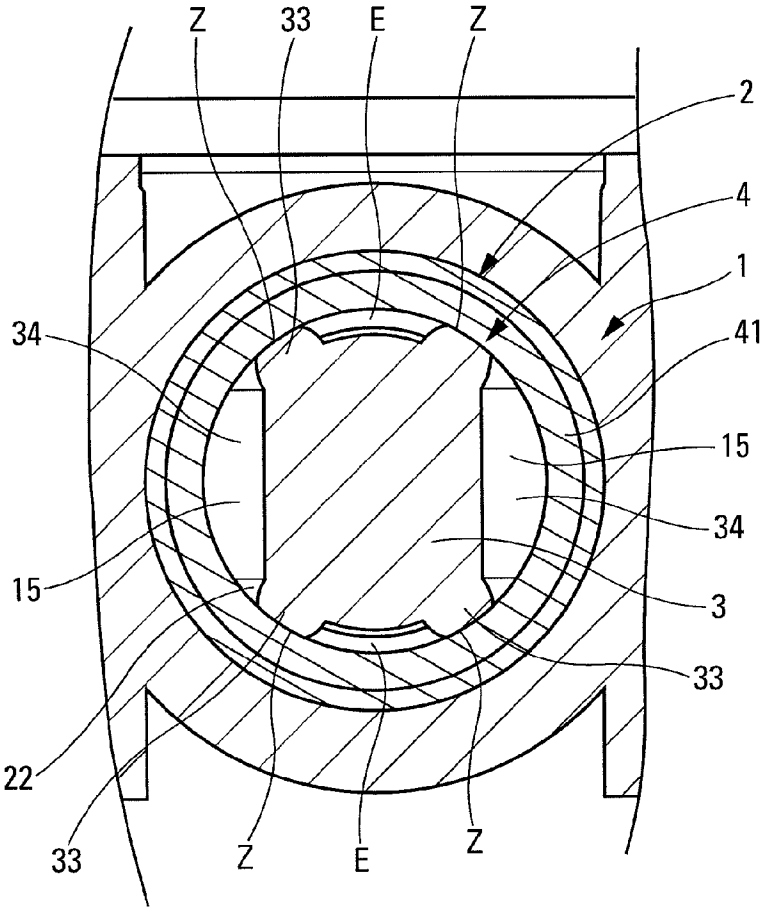
FIG. 4 is a vertical section view of the dispenser head of the present invention on a plane passing through the pin and the nozzle.

The nozzle 4 presents a substantially-conventional configuration in the shape of a cup, thereby comprising a substantially-cylindrical wall 41 that is open at one end and that is closed at its opposite end by a dispenser wall 42 in which there is formed a spray orifice 43. At its open end, the cylindrical wall 41 defines a free annular edge 44. The nozzle 4 is a part that is preferably circularly symmetrical about an axis X, as shown in FIG. 1. In other words, the nozzle 4 does not need to be oriented angularly, prior to being presented in front of the inlet of the axial assembly housing 2. This represents a great advantage compared to prior-art document EP-0 802 827. Thus, the nozzle 4 can be engaged axially without any particular orientation in the axial assembly housing 2, as shown in FIG. 1. Once axial assembly has been completed, the nozzle 4 is in the configuration shown in FIG. 2. Its dispenser wall 42 comes into leaktight contact with the front wall 32 of the pin 3, in such a manner as to isolate and finish off the swirl channels 35 and the swirl chamber 36. It can even be observed in FIG. 2 that the dispenser wall 42 internally forms a portion 46 of the swirl chamber, in addition to the swirl chamber 36 formed in the pin. In addition, the cylindrical wall 41 of the nozzle 4 comes into clamping and leaktight contact with the inside wall 21 of the housing 2, and with the splines 33 of the pin 3, as can be seen in FIG. 4. Thus, the pin 3 and the cylindrical wall 41 of the nozzle 4 define between them four spaces, namely two connection sections 34 and two dead spaces E. The connection sections 34 connect the feed ducts 15 to the swirl channels 35. This can be seen in FIG. 2. It can also be said that the connection sections 34 extend the feed ducts 15 as far as the swirl channels 35. In addition, the dead spaces E are isolated and are not in communication with the outside. It should also be observed that the free annular edge 44 of the nozzle 4 comes into contact with the radial ridges 23 so as to complete the sealing at the end wall 22 of the housing.

It can thus be said that the nozzle 4 comes into contact with the pin 3 by defining a plurality of sealing zones Z that are formed by the splines 33 coming into contact with the side wall 41 of the nozzle. This can clearly be seen in FIG. 4. It is even possible to envisage that the splines 33 are deformed a little by the side wall 41 so as to improve sealing. In this embodiment, the sealing zones Z are four in number, but it is also possible to envisage making the dispenser head of the invention with only two sealing zones, or, on the contrary, with three sealing zones, or even with more than four sealing zones. By way of example, it is possible to replace two splines 33 by a cylinder segment that comes into intimate contact with the cylindrical wall 41 of the nozzle. In this configuration, there would not be any dead spaces E. The present embodiment is advantageous since the rectangular shape of the pin makes it possible to define two connection sections that are associated with the feed ducts 15.

It should be observed that the two swirl channels 35 are thus fed in identical, balanced, and symmetrical manner by the two feed ducts 15 and the two connection sections 34. This results from the fact that the ducts 15 and the connection sections 34 are disposed in completely symmetrical manner on either side of the axis X. In addition, given that the two feed ducts 15 leave the inlet well 14 at the same height on the axis Y, the two swirl channels, and consequently the swirl chamber 36, are guaranteed to be fed with fluid in completely symmetrical manner. Each swirl channel 35 brings the same quantity of fluid at the same speed to the swirl chamber 36, thereby encouraging the formation of a perfect vortex. It follows that the quality of the spray through the spray orifice 43 is optimum.

Without going beyond the ambit of the invention, and by way of example, it is also possible to envisage making a dispenser head including four swirl channels that are fed in symmetrical manner by two feed ducts and two connection sections: each pair of swirl channels thus being fed by one feed duct and one connection section. It is also possible to envisage making a dispenser head with three swirl channels that are fed by three feed ducts and three connection sections.

Optionally, the head body 1 may be engaged in a cover 5 that includes a side opening 54 through which the nozzle 4 can pass.

The invention claimed is:

1. A fluid dispenser head comprising:

an inlet well for connecting to an outlet of a dispenser member;

an axial assembly housing in which there extends a pin defining a side wall and a front wall; and a cup-shaped nozzle comprising a substantially-cylindrical wall having an end that is closed by a dispenser wall that forms a spray orifice, the nozzle being assembled along an axis X in the axial assembly housing, with the substantially-cylindrical wall engaged around the pin, and the dispenser wall in axial abutment against the front wall of the pin;

the head further comprising:

at least two feed ducts, each connecting the inlet well to the axial assembly housing;

the front wall of the pin forming at least two swirl channels that are connected in tangential manner to a swirl chamber that is centered on the spray orifice; and the cylindrical wall of the nozzle being in sealing contact with the side wall of the pin so as to define at least two connection sections, each connecting a feed duct to a swirl channel, the cylindrical wall of the nozzle being in sealing contact with the side wall of the pin at at least two sealing zones that extend in substantially axial manner from the ducts to the channels so as to form the at least two connection sections, wherein the sealing zones are linear and axial, Wherein the sealing zones are formed by axial splines on the pin that are in contact with the cylindrical wall of the nozzle, the axial spline protrusions extending along the direction of the axis X.

2. A dispenser head according to claim 1, wherein there are four sealing zones defining the at least two connection sections, and there are two dead spaces.

3. A dispenser head according to claim 1, wherein each sealing zone further includes a radial sealing ridge that is formed in the axial assembly housing, the cylindrical wall of the nozzle defining a free annular edge that is in contact with the sealing ridges so as to provide sealing at a bottom of the axial assembly housing.

4. A dispenser head according to claim 1, wherein the inlet well extends along an axis Y that is transverse to the axis X, such that the feed ducts are connected over the height of the well, the heights of the two ducts in the well, along the axis Y, being identical.

5. A dispenser head according to claim 1, wherein the flow paths of the fluid from the inlet of the feed ducts to the spray orifice, via the feed ducts, the at least two connection sections, the swirl channels, and the swirl chamber, are identical in length and in configuration.

6. A dispenser head according to claim 1, wherein part of the swirl chamber is formed by the dispenser wall of the nozzle.

7. A dispenser head according to claim 1, wherein the housing and the cylindrical wall of the nozzle are circularly symmetrical around the axis X.

8. A dispenser head according claim 2, wherein the sealing zones are formed by axial splines on the pin that are in contact with the cylindrical wall of the nozzle.

9. The dispenser head according claim 1, wherein the dispenser member is a pump or a valve.

10. A fluid dispenser head comprising:

an inlet well configured to connect to an outlet of a dispenser member;

an axial assembly housing;

a pin extending through the axial assembly housing, the pin having two side walls and a front wall at a distal downstream end of the pin, the front wall comprising swirl channels;

a cup-shaped nozzle comprising an interior surface abutting the front wall of the pin and comprising a substantially-cylindrical interior wall closed downstream by a dispenser wall having a spray orifice, the nozzle assembled along an axis in the axial assembly housing with the substantially-cylindrical wall engaged around the pin;

two feed ducts, each connecting the inlet well to the axial assembly housing;

wherein the substantially-cylindrical wall of the nozzle is in sealing contact with one or more portions of axially extending protrusions on the side walls of the pin so as to define at least two connection sections, each connecting an axially extending feed duct to a corresponding one of the swirl channels.

11. The fluid dispenser according to claim 10, wherein each of the two side walls of the pin is flat and defines a wall of a corresponding one of the feed ducts.

12. The fluid dispenser according to claim 10, wherein each of the two feed ducts directly connect inlet the well to a corresponding one of the swirl channels.

13. The dispenser head according to claim 1, wherein a linear axial extent of the sealing zones is greater than a circumferential extent of the sealing zones.

14. The fluid dispenser according to claim 10, wherein a linear axial extent of the at least two connection sections is greater than a circumferential extent of the at least two connection sections.

* * * * *